US005494266A

United States Patent [19]

Engelmann et al.

[11] Patent Number: 5,494,266

[45] Date of Patent: Feb. 27, 1996

[54] DISCHARGE ASSEMBLY FOR TUNDISH

[75] Inventors: Kurt Engelmann; Laurenz Keisers, both of Krefeld, Germany

[73] Assignee: Didier-Werke AG, Wiesbaden, Germany

[21] Appl. No.: 331,945

[22] Filed: Oct. 31, 1994

[30] Foreign Application Priority Data

Nov. 13, 1993 [DE] Germany ..... 43 38 859.0

[51] Int. Cl.[6] ..... B22D 41/08

[52] U.S. Cl. ..... 266/236; 266/275; 222/598; 222/599

[58] Field of Search ..... 266/236, 275; 222/590, 591, 594, 597, 598, 599

[56] References Cited

U.S. PATENT DOCUMENTS 3,165,795 1/1965 Bahm ..... 222/598
3,377,006 4/1968 Bahm ..... 222/598

FOREIGN PATENT DOCUMENTS 3274210 12/1991 Japan ..... 222/598
0212460 11/1968 U.S.S.R. ..... 222/598
0270205 8/1970 U.S.S.R. ..... 222/598

*Primary Examiner*—Scott Kastler
*Attorney, Agent, or Firm*—Wenderoth, Lind & Ponack

[57] ABSTRACT

A vessel, for example a metallurgical tundish for multi-strand casting, has at least one discharge assembly/block. Such assembly includes a refractory perforated brick fitted in the vessel, the perforated brick having therethrough an opening that is at least partially defined by a surface that is rotationally symmetrical about a longitudinal center axis of the opening. A refractory nozzle brick has a peripheral surface that is rotationally symmetrical about a longitudinal center axis of the nozzle brick. The nozzle brick has therethrough a discharge opening that is located eccentrically of the longitudinal center axis of the nozzle brick. The nozzle brick fits into the opening in the perforated brick with the longitudinal center axes thereof coincident, such that the nozzle brick is rotatable relative to the perforated brick about a rotation axis that is defined by the coincident longitudinal center axes.

30 Claims, 4 Drawing Sheets

DISCHARGE ASSEMBLY FOR TUNDISH

BACKGROUND OF THE INVENTION

The present invention relates to an improved vessel for containing molten material and including at least one discharge assembly for discharging molten material from such vessel. The present invention particularly relates to a matallurgical vessel and further particularly to a tundish for achieving multi-strand casting for casting identical or ently configured steel shapes, for example for casting plural continuous strands, possibly having different cross-sectional configurations. Yet further, the present invention is directed to such a casting plant wherein each strand there is provided at least one discharge block or discharge assembly formed of a refractory perforated brick and a refractory nozzle brick installed in the perforated brick and having a discharge opening for discharge of the molten material, for example molten steel. Yet further, the present invention is directed to an improved discharge block or discharge assembly for use in such a vessel, particularly a metallurgical vessel, and further particularly a tundish.

According to the state of the art, a tundish for casting one or more strands having an I-shaped cross-sectional configuration is provided with a pair of discharge blocks or assemblies. The two discharge assemblies are fixed at respective positions of the tundish for achieving casting particular desired cross-sectional configuration. In other words, the two discharge assemblies for discharging a given strand configuration are positioned relative to the tundish and relative to each other as a function the particular cross-sectional configuration to be cast. If different cross-sectional con figurations, for example I-shaped, are to be east neously, the respective discharge blocks or discharge assemblies for each configuration to be cast have to be positioned correspondingly at the tundish, both with respect to the longitudinal alignment thereof and also with respect to the transverse alignment thereof. The discharge opening of each nozzle brick is arranged concentrically of the respective discharge block/assembly and must be along the center line of the particular strand configuration/profile to be cast. As a result, to be able to achieve normal production capabilities, it is necessary to provide a plurality of discharge blocks/assemblies that are mounted interchangeably to the tundish to achieve different cast configurations. Aligning of such plural discharge blocks/assemblies is cumbersome and time-consuming, and thus delays conversion of a tundish from casting of one profile/configuration to another profile/configuration.

SUMMARY OF THE INVENTION

Accordingly, it is an object of the present invention to provide an improved molten material containing vessel, particularly a metallurgical vessel, and further particularly a tundish, having a construction such that conversion to different casting configurations/profiles is a simple operation and easy to implement.

A further object of the present invention is to provide such a vessel having an improved arrangement of discharge blocks/assemblies whereby it is possible to overcome the above and other prior art advantages.

It is a yet further object of the present invention to provide such an improved discharge block or discharge assembly.

The above objects are achieved in accordance with the present invention by the provision that the discharge assembly/block is formed of a refractory perforated brick fitted to the vessel. The perforated brick has therethrough an opening that is at least partially defined by a surface that is rotationally symmetrical about a longitudinal center axis of the opening. A refractory nozzle brick has a peripheral surface that is rotationally symmetrical about a longitudinal center axis of the nozzle brick. The nozzle brick has therethrough a discharge opening that is located eccentrically of the longitudinal center axis of the nozzle brick. The nozzle brick is positioned within the opening in the perforated brick with the longitudinal center axes thereof coincident. The nozzle brick is rotatable to plural positions relative to the perforated brick about a rotation axis that is defined by the coincident longitudinal center axes of the two bricks.

In accordance with this arrangement of the present invention, the vessel, for example a tundish, easily and rapidly can be adjusted to accommodate casting of strands of different cross-sectional configurations/profiles. Transverse alignment of the discharge opening of the nozzle brick with respect to an ideal center line of the strand or profile to be cast is achieved in a simple manner in view of the fact that the nozzle brick is installed in the perforated brick at a corresponding particular angle of relative rotation. Longitudinal alignment of the discharge opening is achieved by adjustment of the perforated brick, and thereby of the entire discharge assembly, relative to the tundish. In other words, the entire assembly is movable relative to the tundish in a longitudinal direction, but rotation of the nozzle brick relative to the perforated brick achieves transverse adjustment of the discharge opening. Thus, different profiles or cross-sectional configurations, such as different I-shaped profiles, billet profiles or bloom profiles, can be cast simultaneously or in succession using the same discharge blocks that easily can be adjusted both longitudinally and transversely.

The nozzle brick may be in the form of a submerged nozzle brick that can be used for submerged casting, or can be of shorter length not contemplated as being submerged. Thus, the present invention equally is applicable to open or closed casting.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
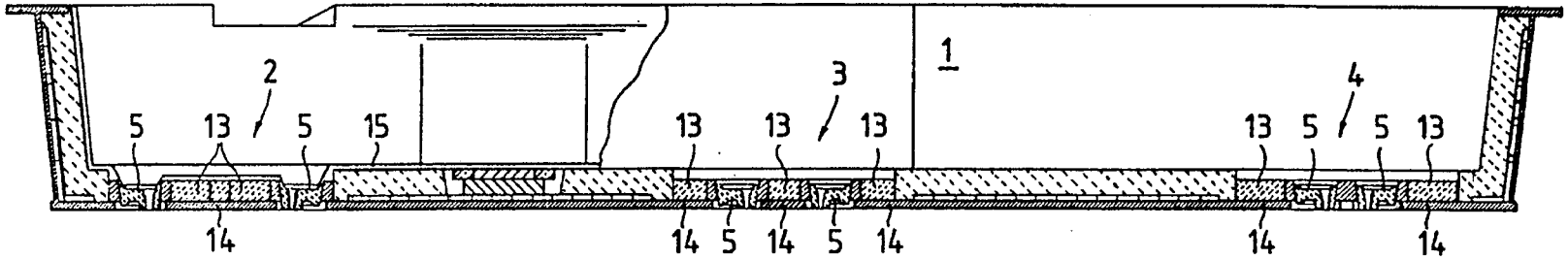
FIG. 1 is a longitudinal cross-sectional view of a tundish in accordance with the present invention.
Figure 2:
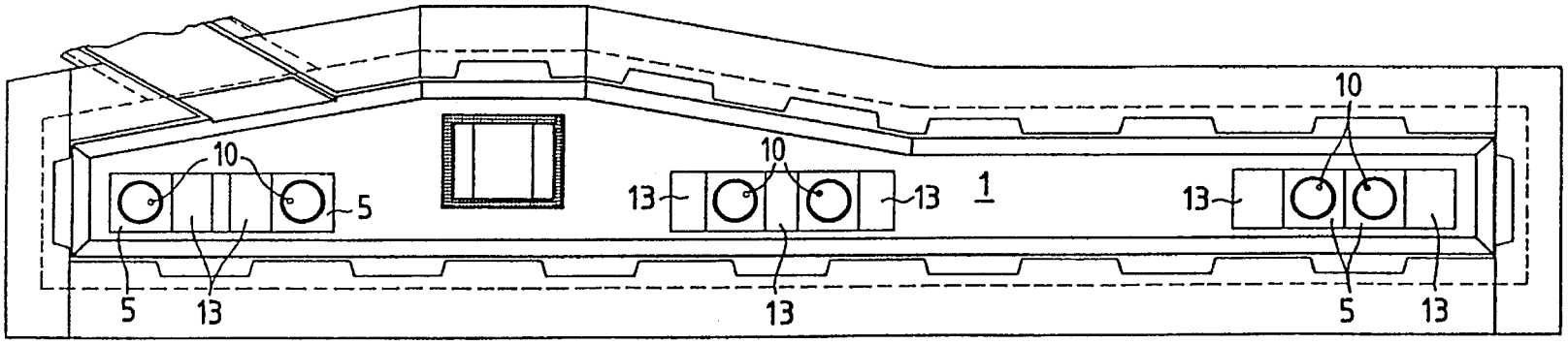
FIG. 2 is a plan view of the tundish of FIG. 1.

FIGS. 1 and 2 generally illustrate an elongated tundish 1 intended for casting three strands. Tundish 1 has in a bottom thereof respective recesses 2, 3, 4. A pair of discharge blocks or discharge assemblies 5 is installed into each of recesses 2, 3, 4.

Figure 3:
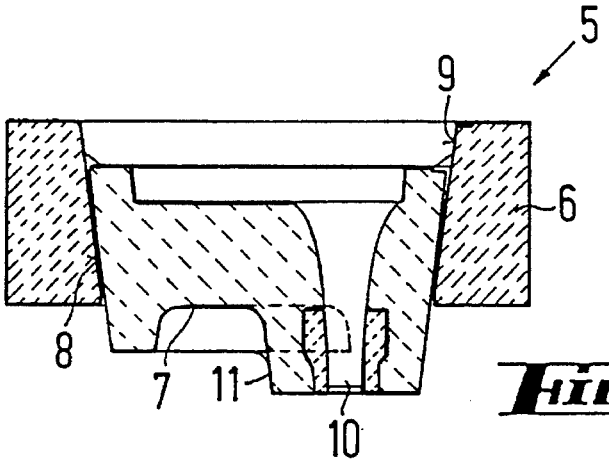
FIG. 3 is a cross-sectional view of a discharge block/assembly in accordance with the present invention.
Figure 4:
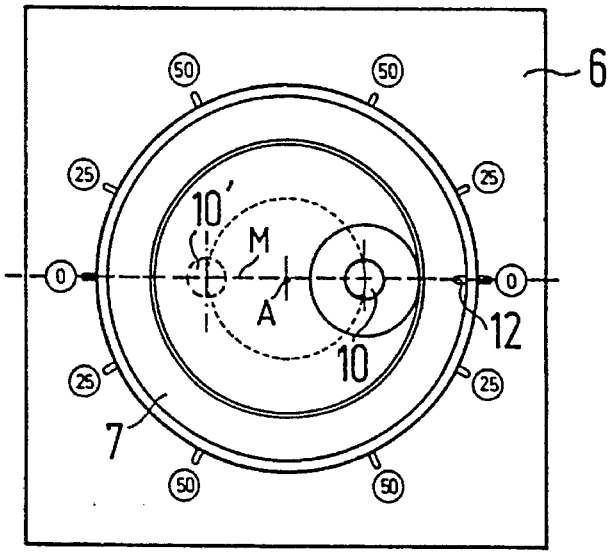
FIG. 4 is a top view of the discharge assembly of FIG. 3, with a nozzle brick thereof being shown in a first setting.

As shown in FIGS. 3 and 4, each discharge block/assembly is formed of a refractory perforated brick 6 and a refractory nozzle brick 7 installed within perforated brick 6. Perforated brick 6 has a rectangular exterior configuration, preferably square as shown in FIG. 4. Perforated brick 6 has therethrough an opening defined by a surface 9 that is rotationally symmetrical about a longitudinal center axis of such opening. As illustrated, the opening and surface 9 are circularly conical. Nozzle brick 7 has a peripheral surface 8 that is rotationally symmetrical about a longitudinal center axis of nozzle brick 7. As illustrated, peripheral surface 8 is circularly conical. As also illustrated, surfaces 8, 9 are complementary. Nozzle brick 7 has therethrough a discharge opening 10, for example defined through a nozzle 11 fitted in nozzle brick 7. Discharge opening 10 including the outlet thereof, positioned eccentrically of the longitudinal center axis of nozzle brick 7. As illustrated particularly in FIG. 1, opening 10 includes an inlet that is open through perforated brick 6 to the interior of tundish 1 in all positions of rotation of nozzle brick 7 relative to perforated brick 6. Further, the outlet of discharge opening 10 is open through perforated brick 6 to the exterior of tundish 1 in all positions of rotation of nozzle brick 7 relative to perforated brick 6. Nozzle brick 7 further may be provided with a replacement discharge opening 10' that can be put into service as soon as discharge opening 10 becomes worn. Expediently, replacement discharge opening 10' is arranged diametrically opposite discharge opening 10.

Nozzle brick 7 is positioned within the opening in perforated brick 6, such that the respective longitudinal center axes are coincident and define an axis of rotation A about which nozzle brick 7 is rotatable relative to perforated brick 6. As soon in FIG. 4, the perforated brick 6 and the nozzle brick 7 have indicators to indicate plural rotational positions of nozzle brick 7 relative to perforated brick 6. For example, every circumferentially quarter segment about axis A is shown as having respective markings "0", "25", "50" corresponding to respective intended profiles to be cast. A mark 12 is formed on nozzle brick 7. If nozzle brick 7 is rotated to bring mark 12 into alignment with respective of the marks on perforated brick 6, it is known that the discharge assembly is set for casting of a strand of a particular cross-sectional configuration. Thus, relative rotation of nozzle brick 7 results in displacement of discharge opening 10 transversely.

Figure 6:
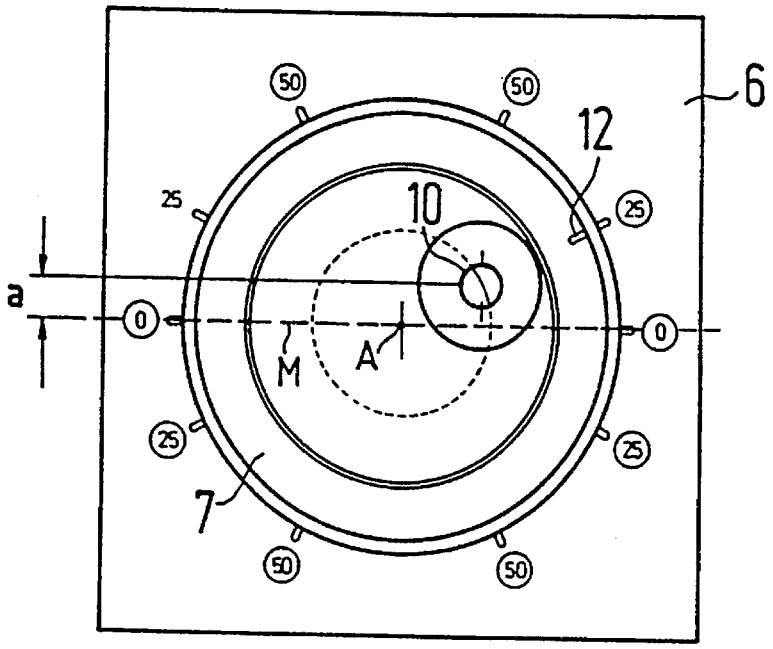
FIG. 6 is a view similar to FIG. 4 but illustrating the nozzle brick in a second setting thereof.
Figure 8:
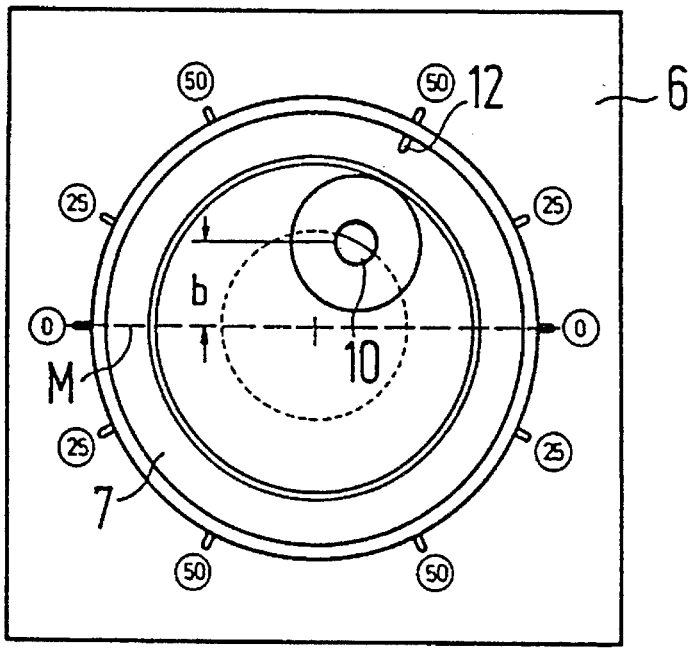
FIG. 8 is a view similar to FIGS. 4 and 6, but illustrating a yet further setting of the nozzle brick.

FIGS. 4, 6, 8 respectively illustrate relative positions of rotation of the left-most discharge assembly 5 of each of the assembly pairs shown with respect to recess 2, recess 3 and recess 4 of FIGS. 1 and 2.

Figure 5:
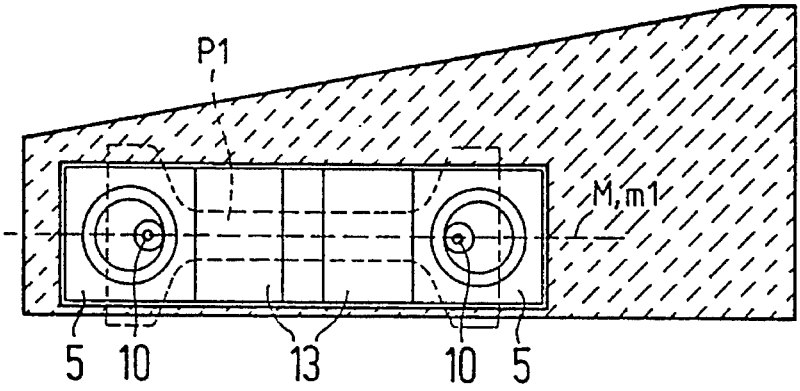
FIG. 5 is a schematic cross-sectional view of a portion of a tundish employing two discharge assemblies with respective settings as shown in FIG. 4.

More particularly, in the angular position of rotation of nozzle brick 7 shown in FIG. 4, discharge opening 10 lies along a longitudinal center line M of discharge assembly 5. 0n the other hand, in the angular position of rotation of nozzle brick 7 shown in FIG. 6, discharge opening 10 is spaced by a distance a from longitudinal center line M. Further, in the angular position of rotation of nozzle brick 7 shown in FIG. 8, the discharge opening 10 is spaced by a distance b from longitudinal center line M. Center line M of discharge assembly 5 extends in the longitudinal direction of recesses 2, 3, 4. Such recesses are longer than the total length of the two discharge assemblies/blocks in the direction of center line M. As a result, spaces will exist between opposite longitudinal ends of discharge assemblies 5 and the respective edges of recesses 2, 3, 4. These spaces are filled with refractory material, in the illustrated arrangement refractory fitting plates 13 of various configurations. Fitting plates 13 are held from below by supporting elements 14 of tundish 1, as shown in FIG. 1. In the arrangement of the left side of FIGS. 1 and 2 and as shown in FIGS. 4 and 5, plates 13 are positioned between the two assemblies 5, and no plates are positioned outwardly of respective assemblies 5. On the other hand, in the arrangement of the center of FIGS. 1 and 2 and in FIGS. 6 and 7, a plate 13 is positioned between the two assemblies 5 and further plates are positioned between each assembly 5 and the respective edge of recess 3. In the arrangement on the right in FIGS. 1 and 2 and in FIGS. 8 and 9, no plate 3 is provided between the two assemblies 5, but larger plates or additional plates are provided between each assembly 5 and the respective end edge of recess 4. In the transverse direction the discharge assemblies/blocks 5 fit into recesses 2, 3, 4. To facilitate correct orientation of discharge assemblies 5 in the recesses, suitable orientation aids can be provided, or the rectangular exterior configuration of perforated bricks 6 can be deviated from the illustrated square configuration.

The arrangement of FIG. 5 is contemplated for use in casting a strand P1 having the profile illustrated by dashed lines. Intended or ideal center line ml of strand P1, or the center line of the mold to be used in formation thereof, coincides with center line M of the two longitudinally spaced assemblies 5. The nozzle bricks 7 of the two discharge assemblies 5 are set as shown in FIG. 4, i.e. to respective marks "0", with the nozzle brick 7 of the illustrated right discharge block set to the mark "0" to the left, and with the left nozzle brick 7 set to the mark "0" to the right. In other words, the two discharge openings 10 are directed relatively toward each other. Discharge of molten steel through the two discharge openings 10 will result in casting of strand P1.

Figure 7:
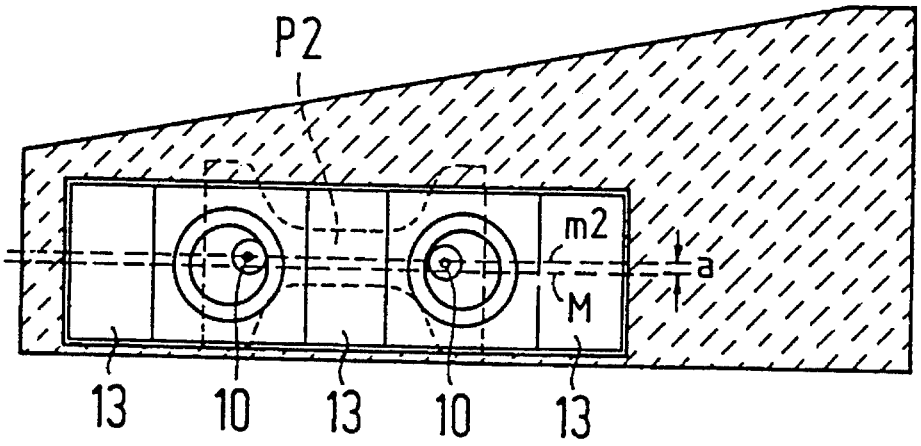
FIG. 7 is a view similar to FIG. 5, but showing the two discharge assemblies with settings according to FIG. 6.

In the arrangement shown in FIG. 7, strand P2 is to be cast. The intended or ideal center line m2 of the strand of this profile deviates from longitudinal center line M of the discharge assemblies 5 by the distance a. To ensure that the discharge openings of the two assemblies 5 lie on the ideal center line m2, two discharge assemblies 5 are used, with the nozzle bricks 7 thereof in the angular positions of rotation shown in FIG. 6. In this regard, the nozzle brick 7 of the left discharge assembly 5 is at the upper right mark "25" and the nozzle brick of the right discharge block is at the upper left mark "25".

Figure 9:
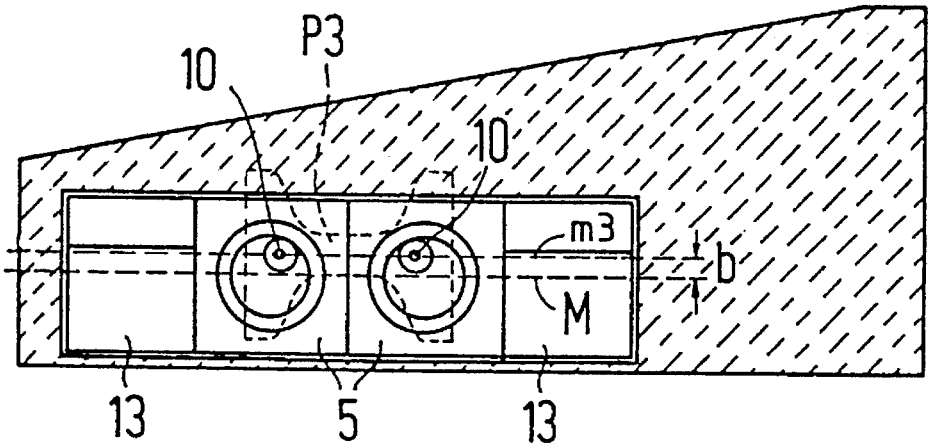
FIG. 9 is a view similar to FIGS. 5 and 7, but illustrating the arrangement of two discharge assemblies having settings corresponding to FIG. 8.

In the arrangement shown in FIG. 9, a strand P3 of the illustrated profile is to be cast. It's ideal or intended center line m3 is spaced from the longitudinal center line M of the discharge assemblies by the distance b. To guarantee that the discharge openings 10 will lie on the ideal center line m3, two discharge assemblies or blocks are used with the nozzle bricks 7 thereof in the angular positions of rotation shown in FIG. 8. The nozzle brick 7 of the left discharge assembly 5 is at the upper right mark "50" and the nozzle brick 7 of the right discharge assembly 5 is at the upper left mark "50".

The examples illustrated in FIGS. 5, 7, 9 are shown in FIGS. 1 and 2 at recesses 2, 3, 4, respectively. Thus, with the same tundish 1 it is possible to cast strands of three different cross-sectional configurations, in the illustrated arrangements I-shaped cross-sectional configurations. If other cross-sectional configurations are to be cast, it is possible to use different arrangements. For example, if a strand to be cast is of a cross-sectional configuration that can be formed by employing one discharge assembly/block 5, it is only necessary to use one assembly, and the discharge opening 10 thereof still may be displaced as desired and/or necessary by rotation of nozzle brick 7. When only one assembly 5 is used, the remaining space in the corresponding recess 2, 3, 4 is filled, for example with refractory fitting plates 13.

At such time as a particular nozzle brick 7 becomes worn and must be replaced, then it easily is possible to remove the worn nozzle brick and replace it with a new nozzle brick 7. Further, when it becomes necessary to change the set-up to achieve casting of a strand of a different profile, fitting plates 13 can be removed, the discharge assembly or assemblies 5 can be repositioned, or different assemblies or assembly can be installed and properly positioned relative to the respective recesses in the direction of center line M. The fitting plates 13 then can be fitted as necessary for the new installation.

Although the present invention has been described and illustrated with respect to preferred features, arrangements and embodiments thereof, it is to be understood that various modifications and changes may be made to the specifically described and illustrated arrangements without departing from the spirit and scope of the present invention. For example, it would be possible to use different markings or indicia than illustrated. Similarly, it would be possible to use other indicating arrangements, structures or devices, as would be understood by one of ordinary skill in the art from the present disclosure. All such changes and modifications are intended as being encompassed by the present invention.

We claim:

1. In a vessel for containing molten material and including at least one discharge assembly for discharging molten material from said vessel, the improvement wherein said discharge assembly comprises:

a refractory perforated brick fitted in said vessel, said perforated brick having therethrough an opening that is at least partially defined by a surface that is rotationally symmetrical about a longitudinal center axis of said opening;

a refractory nozzle brick having a peripheral surface that is rotationally symmetrical about a longitudinal center axis of said nozzle brick, said nozzle brick having therethrough a discharge opening having an outlet located eccentrically of said longitudinal center axis of said nozzle brick and an inlet;

said nozzle brick fitting into said opening in said perforated brick with said longitudinal center axes thereof coincident, said nozzle brick being rotatable relative to said perforated brick about a rotation axis defined by said coincident longitudinal center axes;

said inlet of said discharge opening being open through said perforated brick and in open communication with the interior of said vessel in all positions of rotation of said nozzle brick relative to said perforated brick; and said outlet of said discharge opening being open through said perforated brick and in open communication with the exterior of said vessel in all positions of rotation of said nozzle brick relative to said perforated brick.

2. The improvement claimed in claim 1, wherein said peripheral surface of said nozzle brick is complementary to said surface of said perforated brick.

3. The improvement claimed in claim 2, wherein said surfaces are circularly conical.

4. The improvement claimed in claim 1, wherein said perforated brick has a rectangular exterior configuration.

5. The improvement claimed in claim 4, wherein said exterior configuration is square.

6. The improvement claimed in claim 1, wherein said nozzle brick has therethrough a replacement discharge opening located eccentrically of said longitudinal center axis of said nozzle brick.

7. The improvement claimed in claim 6, wherein said replacement discharge opening is positioned diametrically opposite said discharge opening.

8. The improvement claimed in claim 1, said perforated brick and said nozzle brick have indicators to indicate rotational positions of said nozzle brick relative to said perforated brick.

9. The improvement claimed in claim 1, wherein said vessel has therein a recess, and said discharge assembly is positioned within said recess.

10. The improvement claimed in claim 9, wherein a space between said discharge assembly and at least one edge of said recess is filled with refractory material.

11. The improvement claimed in claim 10, wherein said refractory material comprises a refractory fitting plate.

12. The improvement claimed in claim 9, comprising plural discharge assemblies positioned within said recess.

13. The improvement claimed in claim 12, comprising two discharge assemblies positioned within said recess.

14. The improvement claimed in claim 12, wherein said plural discharge assemblies are aligned in a longitudinal direction of said recess.

15. The improvement claimed in claim 14, wherein spaces between longitudinal ends of said discharge assemblies and respective longitudinal ends of said recess are filled with refractory material.

16. The improvement claimed in claim 15, wherein said refractory material comprises refractory fitting plates.

17. The improvement claimed in claim 14, wherein a space between adjacent said discharge assemblies is filled with refractory material.

18. The improvement claimed in claim 17, wherein said refractory material comprises at least one refractory fitting plate.

19. The improvement claimed in claim 1, wherein said vessel has therein plural recesses, each said recess having positioned therein a respective discharge assembly.

20. The improvement claimed in claim 19, wherein said plural recesses are aligned in a longitudinal direction of said vessel.

21. The improvement claimed in claim 19, comprising plural discharge assemblies positioned within at least one said recess.

22. The improvement claimed in claim 21, wherein said plural discharge assemblies are aligned in a longitudinal direction of said at least one recess.

23. A discharge assembly to be fitted in a molten material containing vessel to enable discharge of molten material therefrom, said discharge assembly comprising:

a refractory perforated brick to be fitted in the vessel, said perforated brick having therethrough an opening that is at least partially defined by a surface that is rotationally symmetrical about a longitudinal center axis of said opening;

a refractory nozzle brick having a peripheral surface that is rotationally symmetrical about a longitudinal center axis of said nozzle brick, said nozzle brick having therethrough a discharge opening having an outlet located eccentrically of said longitudinal center axis of said nozzle brick and an inlet;

said nozzle brick fitting into said opening in said perforated brick with said longitudinal center axes thereof coincident, said nozzle brick being rotatable relative to said perforated brick about a rotation axis defined by said coincident longitudinal center axes;

said inlet of said discharge opening being open through said perforated brick and to be in open communication with the interior of said vessel in all positions of rotation of said nozzle brick relative to said perforated brick; and said outlet of said discharge opening being open through said perforated brick and to be in open communication with the exterior of said vessel in all positions of rotation of said nozzle brick relative to said perforated brick.

24. A discharge assembly as claimed in claim 23, wherein said peripheral surface of said nozzle brick is complementary to said surface of said perforated brick.

25. A discharge assembly as claimed in claim 24, wherein said surfaces are circularly conical.

26. A discharge assembly as claimed in claim 23, wherein said perforated brick has a rectangular exterior configuration.

27. A discharge assembly as claimed in claim 26, wherein said exterior configuration is square.

28. A discharge assembly as claimed in claim 23, wherein said nozzle brick has therethrough a replacement discharge opening located eccentrically of said longitudinal center axis of said nozzle brick.

29. A discharge assembly as claimed in claim 28, wherein said replacement discharge opening is positioned diametrically opposite said discharge opening.

30. A discharge assembly as claimed in claim 23, wherein said perforated brick and said nozzle brick have indicators to indicate rotational positions of said nozzle brick relative to said perforated brick.

* * * * *